US006994112B2

(12) United States Patent
Garman et al.

(10) Patent No.: US 6,994,112 B2
(45) Date of Patent: Feb. 7, 2006

(54) CONTROL UNIT FOR INFLATABLE DEVICES

(75) Inventors: David Edmund Talbot Garman, Powys (GB); Simon Christopher Jackson, Hants (GB)

(73) Assignee: Mangar International Limited, Presteigne (GB)

( * ) Notice: Subject to any disclaimer, the term of this patent is extended or adjusted under 35 U.S.C. 154(b) by 0 days.

(21) Appl. No.: 10/746,332

(22) Filed: Dec. 23, 2003

(65) Prior Publication Data

US 2005/0028875 A1 Feb. 10, 2005

(30) Foreign Application Priority Data

Aug. 8, 2003 (GB) ..... 0318675

(51) Int. Cl.
*A61G 7/018* (2006.01)
*G05G 1/02* (2006.01)
*F15B 13/08* (2006.01)

(52) U.S. Cl. ..... 137/596.2; 254/93 HP

(58) Field of Classification Search ..... 137/596.2; 254/93 HP

See application file for complete search history.

(56) References Cited

U.S. PATENT DOCUMENTS

| | | | | |
|---|---|---|---|---|
| 3,363,941 | A * | 1/1968 | Wierwille | 297/DIG. 3 |
| 3,743,807 | A | 7/1973 | Paulson et al. | |
| 3,798,684 | A | 3/1974 | Bennice et al. | |
| 4,190,286 | A * | 2/1980 | Bentley | 297/DIG. 3 |
| 4,491,157 | A * | 1/1985 | Hashimoto | 137/596.2 |
| 4,589,695 | A * | 5/1986 | Isono | 297/DIG. 3 |

FOREIGN PATENT DOCUMENTS

| | | |
|---|---|---|
| EP | 2000078242 | 9/2001 |
| GB | 2238293 | 5/1991 |
| GB | 2359063 | 8/2001 |
| WO | WO 99/52487 | 10/1999 |

* cited by examiner

*Primary Examiner*—Stephen M. Hepperle
(74) *Attorney, Agent, or Firm*—Notaro & Michalos P.C.

(57) ABSTRACT

The present invention is a control unit which controls the supply of compressed air to a plurality of inflatable devices for inflating them and for venting air from them in order to deflate them. The unit has valves which are operated by finger operable devices. The valves are arranged in two groups. The first group of valves are disposed between an inlet connected to the source of compressed air and a corresponding number of individual ports which are connected to the inflatable devices. The second group of valves are connected between a venting outlet and the ports or a corresponding number of further ports which are connected to the inflatable devices.

18 Claims, 5 Drawing Sheets

CONTROL UNIT FOR INFLATABLE DEVICES

TECHNICAL FIELD

This invention relates to a control unit for controlling the supply of compressed air to a plurality of inflatable devices in order to inflate them individually, and the venting of air from the devices in order to deflate them.

Such control units have many uses. The unit of the present invention has been devised primarily for use with apparatus for lifting a person who for some reason such as disability or frailty cannot raise himself or herself from the ground or floor, for example after falling, the apparatus comprising a plurality of inflatable air bags secured together in a stack and connected or connectible to a source of compressed air, and a control unit for controlling the flow of compressed air from said source to the individual air bags in order to raise a person supported by the stack to a height dependant on the number of air bags which are inflated.

Various forms of such apparatus are known which are adapted to operate at relatively low air pressures of up to 0.35 Bar (5 p.s.i.) (compared, for example, with the higher pressure required to operate power tools).

The object of the present invention is to provide an improved form of control unit for the purpose specified.

A particular aim of the invention is to provide an improved form of control unit which is suitable for use in an apparatus for lifting a person as described above, especially such an apparatus which is adapted to operate at relatively low air pressures of up to 0.35 Bar (5 p.s.i.) and is easily portable.

DISCLOSURE OF THE INVENTION

According to the invention there is provided a hand-held control unit for controlling the supply of compressed air to a plurality of inflatable devices in order to inflate them, and the venting of air from the devices in order to deflate them, wherein the unit is provided with a plurality of valves operable directly by respective finger-operable devices, the valves being arranged in two groups, the valves of one group being operatively disposed between an inlet connected or connectible to a source of compressed air and a corresponding number of individual ports connected or connectible to the respective devices, and the valves of the other group being operatively connected between a venting outlet and either the said ports or a corresponding number of further ports which are connected or connectible to the respective chambers.

Preferably the finger-operable devices are push-buttons. Conveniently the devices of each group are disposed in a row which when the unit is placed in the palm of the hand, extends transversely with respect to the fingers whereby the devices can be operated by the fingers in the manner of a musical wind instrument.

Preferably the two groups of said devices are disposed on respectively opposite faces of the control unit so that by simply turning the unit in the palm of the hand through approximately 180° the group of devices to be operated can be changed.

Preferably the same ports are used for the supply of compressed air to the chambers and the venting of air from the chambers, Each valve preferably comprises a valve element having a stem and a head which is arranged to co-operate with a valve seat, the associated push-button being arranged to act directly on said stem.

According to a second aspect of the invention, there is provided a hand-held control unit for controlling the supply of compressed air to a plurality of inflatable devices in order to inflate them, and the venting of air from the devices in order to deflate them, wherein the unit is provided with a plurality of finger-operable devices which are arranged in two groups, the finger-operable devices of one group being adapted, respectively, to control the supply of compressed air to the individual inflatable devices and the finger-operable devices of the other group being adapted, respectively, to control the venting of air from the individual inflatable devices, wherein the two groups of said devices are disposed on respectively opposite faces of the control unit so that by simply turning the unit in the palm of the hand through approximately 180° the group of devices to be operated by the fingers can be changed.

According to a further aspect of the invention there is provided apparatus for lifting a person from the ground or floor, the apparatus comprising a plurality of inflatable air bags secured together in a stack and connected or connectible to a source or compressed air, and a control unit for controlling the flow of compressed air from said source to the individual air bags in order to inflate them and the venting of air from the bags in order to deflate them, wherein the control unit is constructed in accordance with the first or second aspect of the invention.

The foregoing features of the invention will be more readily understood upon consideration of the following detailed description of the invention, taken in conjunction with the accompanying drawings.

DETAILED DESCRIPTION

Figure 1:
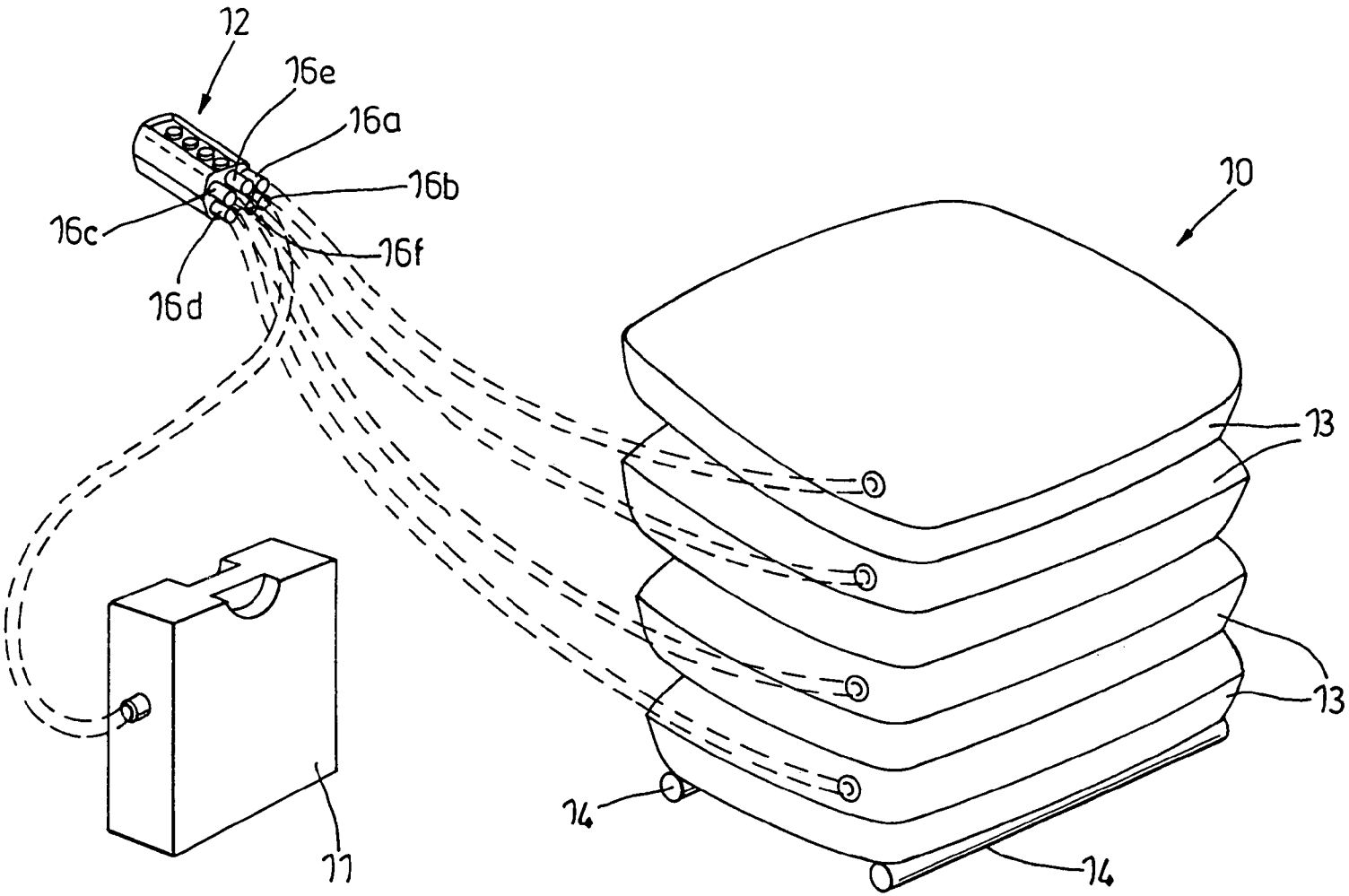
FIG. 1 is a perspective view of an apparatus for lifting a person which incorporates a control unit according to the present invention.

Referring to the drawings which form part of the disclosure herein, as shown in FIG. 1 an apparatus for use in lifting a person who cannot raise himself or herself from the floor, for example after falling, comprises an inflatable support 10, an air compressor 11 for producing a supply of pressurized air and a control unit 12 for controlling the flow of air from the compressor to the support in order to inflate it and venting of air from the support in order to deflate it.

The support 10 comprises four rectangular air bags 13 which are secured together in a stack. When inflated the bags are each of pillow-shape and when deflated the bags lie flat on the floor. Two bars 14 are attached to the lower bag to provide a rigid stable base for the support.

Figure 2:
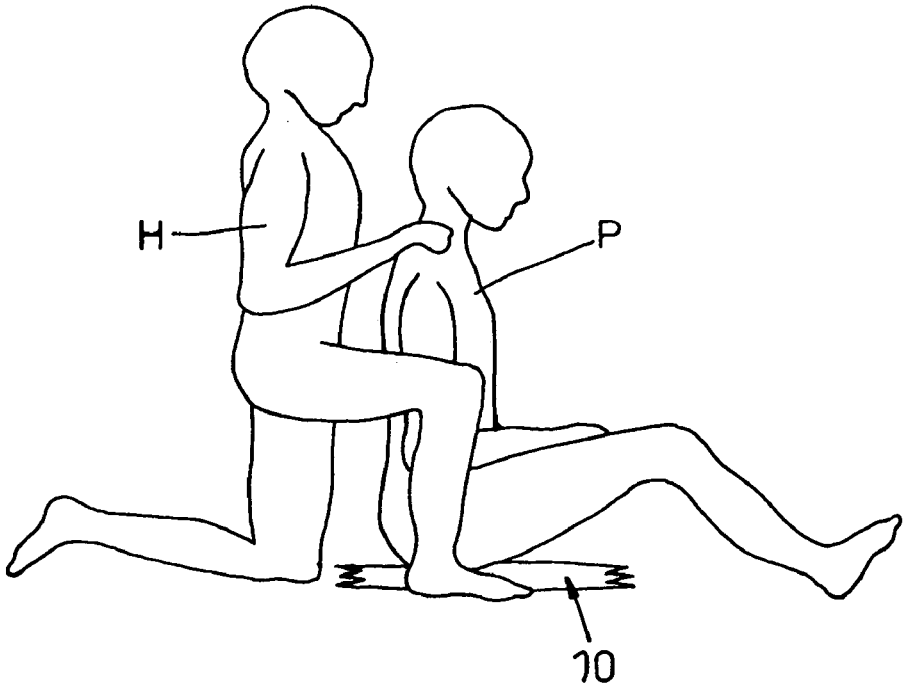
FIG. 2 and FIG. 3 are diagrammatic representations showing the manner in which the apparatus of FIG. 1 is used.
Figure 3:
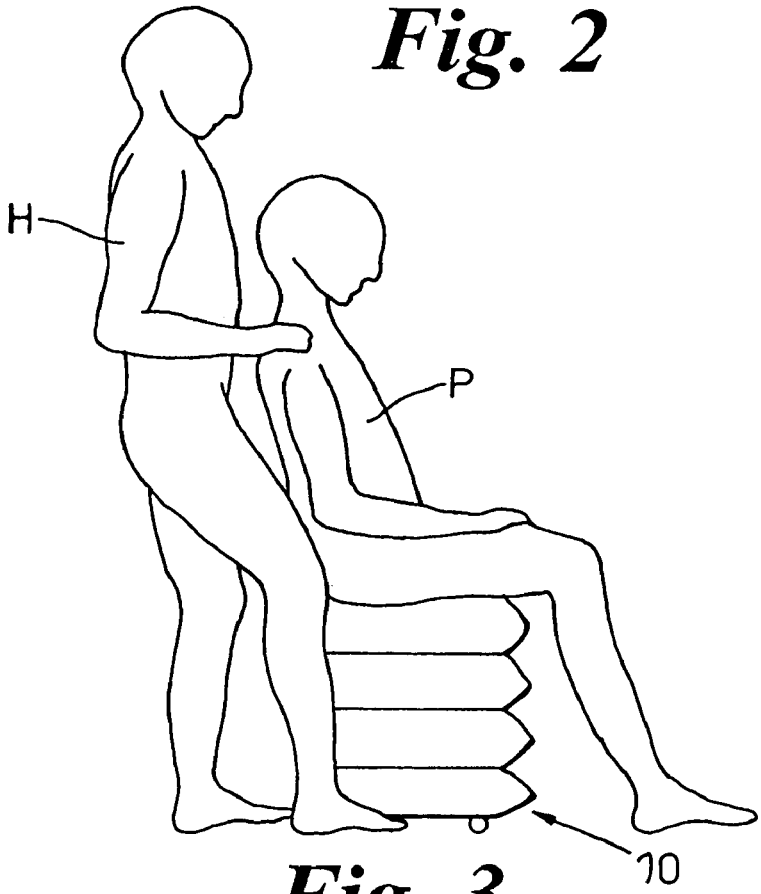
Figure 4:
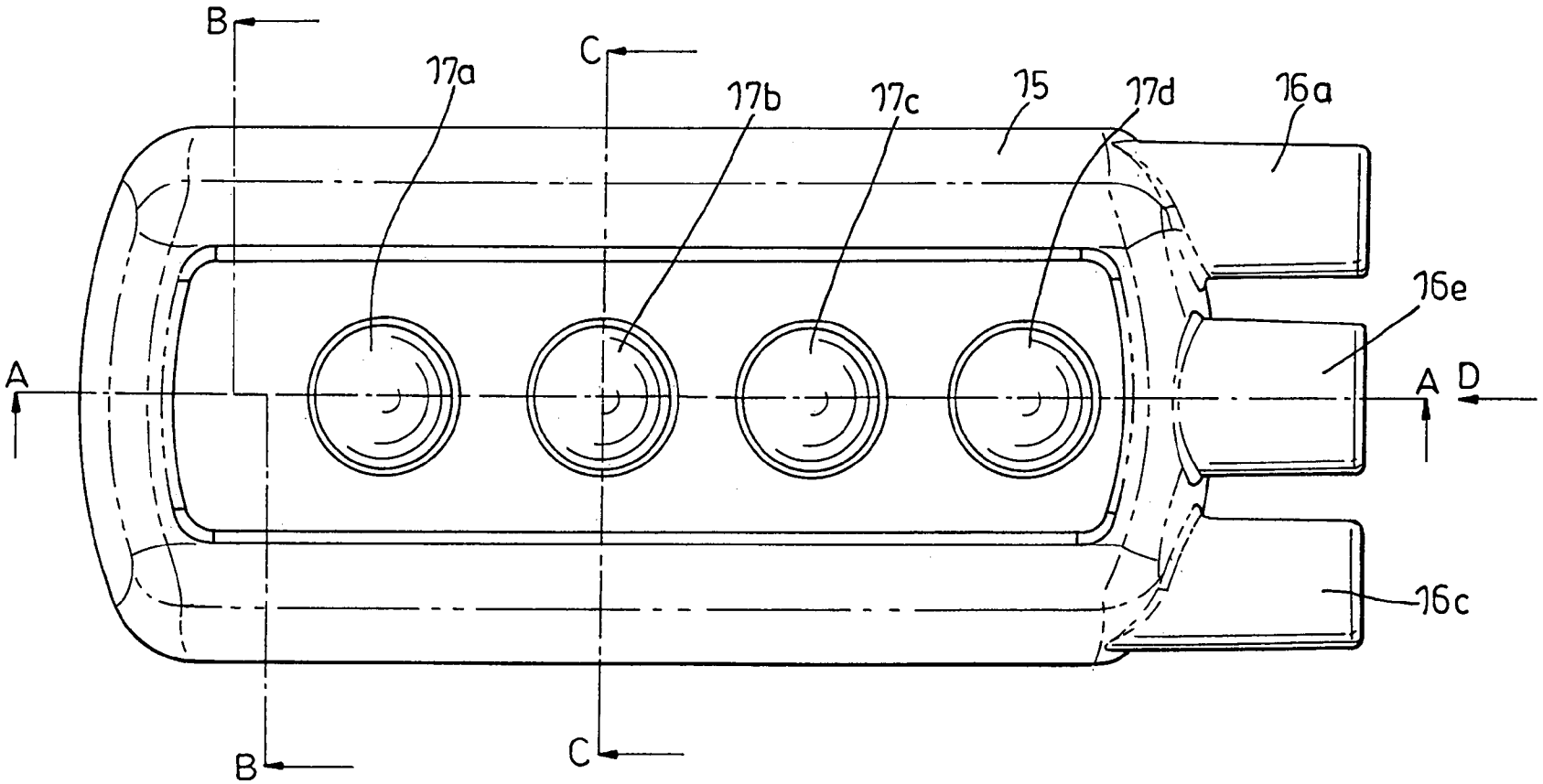
FIG. 4 is a plan view of the control unit.
Figure 5:
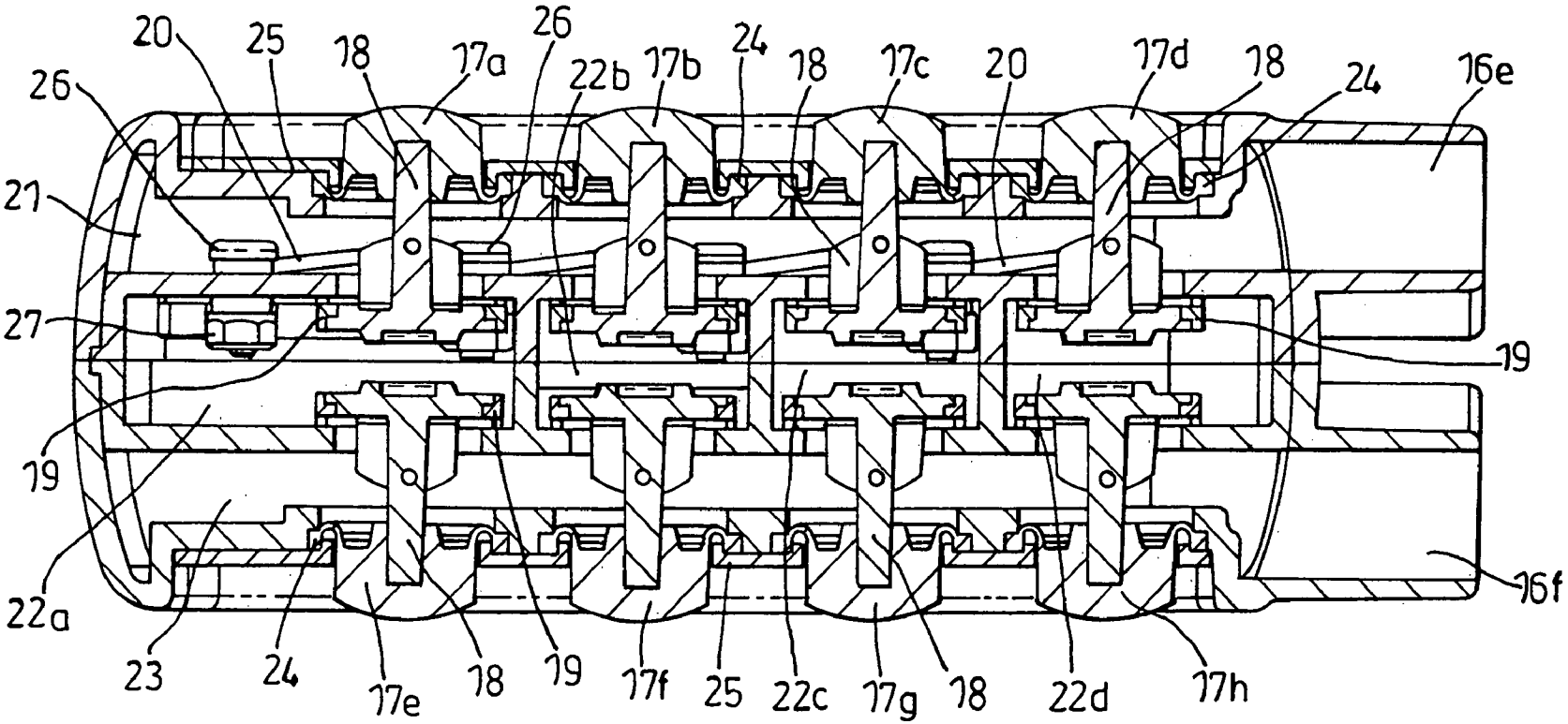
FIG. 5 is a longitudinal sectional view of the control unit taken on the line A—A in FIG. 4.
Figure 8:
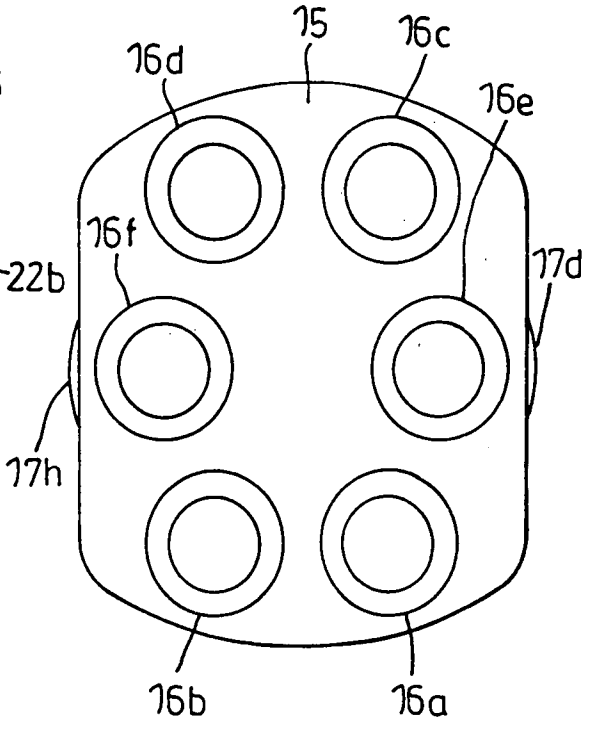
FIG. 8 is an end view of the control unit taken in the direction of arrow D in FIG. 4.
Figure 7:
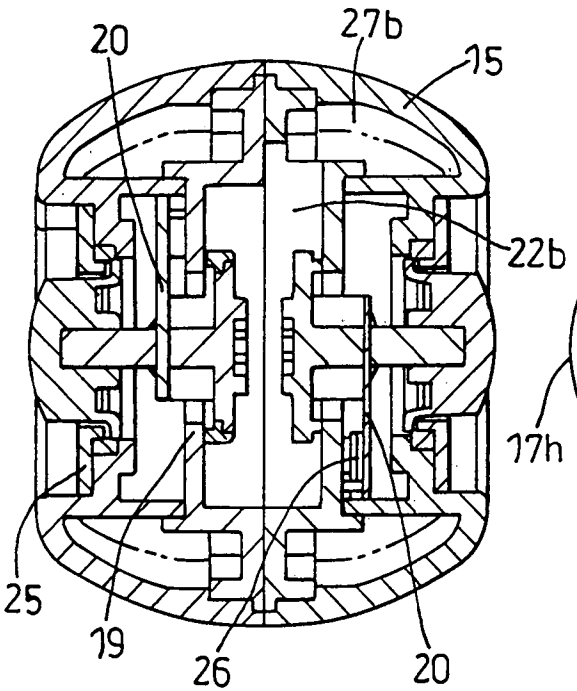
FIG. 7 is a cross sectional view taken on the line C—C in FIG. 4.
Figure 6:
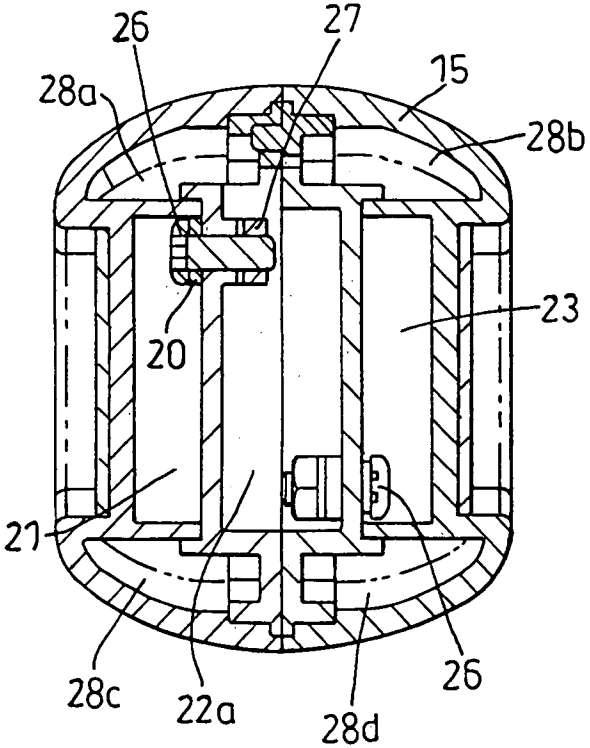
FIG. 6 is a cross sectional view taken on the line B—B in FIG. 4.

FIGS. 2 and 3 show the manner in which the apparatus is designed to be used. A person P who is required to be raised from the floor is helped by the operator H of the apparatus to move into an upright position sitting on the deflated support 10 (FIG. 2). The control unit 12 is then operated to cause compressed air to flow to the air bags 13 in order to inflate them and thereby raise the person P from the floor (FIG. 3). It is then easier for the person to stand up or be lifted into a wheelchair or on to a bed or chair. The control unit is then operated to vent the air bags 13 so that they can be flattened and folded for insertion into a carrying bag together with the bars 14.

The compressor 11 is portable and battery-powered. It is adapted to produce a supply of air at a pressure of up to 0.35 Bar (5 p.s.i.).

The control unit 12 which is constructed and designed in accordance with the present invention is shown in detail in FIGS. 4–7 and comprises an elongate housing 15 formed at one end with six ports 16*a*, 16*b*, 16*c*, 16*d*, 16*e* and 16*f*. Each port is defined by a hollow spigot projecting from the housing.

Two rows each of four finger-operable devices in the form of rubber push-buttons 17 are arranged along respectively opposite sides of the housing 15. The push-buttons marked 17*a*, 17*b*, 17*c* and 17*d* are arranged to control the supply of compressed air to the respective air bags 13 and the push-buttons marked 17*e*, 17*f*, 17*g*, and 17*h* are arranged to vent air from the respective air bags.

Each push-button 17 is recessed to receive one end of the stem of a poppet valve element 18, the opposite end having a head which is arranged to cooperate with a valve seat 19 formed in the housing. A spring 20 acts on each valve element to urge its head into engagement with its valve seat so that the valve is normally closed, the spring being attached to the housing by a screw 26 and a nut 27. The valve can be opened by moving the valve element axially against the action of the spring by depressing and deforming the push-button.

The valve seats 19 of the push-buttons 17*a*–17*d* are located between a chamber 21 formed in the housing in communication with port 16*e* which is an air inlet, and respective chambers 22*a*, 22*b*, 22*c* and 22*d* which communicate, respectively, with the ports 16*a*, 16*b*, 16*c* and 16*d* via channels 28*a*, 28*b*, 28*c*, and 28*d*. The valve seats of the push-buttons 17*e*–17*h* are located between the respective chambers 22*a*–22*d* and a chamber 23 which communicates with port 16*f* which is a venting outlet.

In order to open one of the valves associated with the push-buttons 17*a*–17*d* to allow compressed air to flow to the corresponding air bag, or one of the valves associated with the push-buttons 17*e*–17*h* to vent the corresponding air bag, the corresponding push-button is simply depressed to move its valve element against the action of the associated spring 20. As the apparatus operates at low air pressure, there is negligible resistance to operation of the push-buttons.

The push-buttons 17 are each formed at its inner end with an outwardly projecting lip 24 which engages behind a plate 25 to hold the button in place, the button extending through an aperture in the plate.

The provision of separate push-buttons for inflating and venting the air bags individually firstly enables the support 10 to be expanded and contracted gradually, the air bags being fully inflated and completely deflated one at a time by depressing the push-buttons 17*a*–17*d* and 17*e*–17*h* one at a time in succession. Each bag has to be fully inflated to a stable condition before inflation of the next bag commences. Secondly the number of air bags which are inflated can be varied so as to vary the height to which the support is expanded and hence the distance a person is raised from the ground or floor.

The arrangement of the push-buttons 17 in rows enables them, with the unit held in the palm of the hand, to be operated in the manner of the keys of a musical wind instrument. Also, the arrangement of the rows on opposite sides of the control unit enables the two sets of push buttons to be brought into and out of their in-use positions simply by turning the unit in the palm of the hand through 180°.

What is claimed is:

1. A hand-held control unit for controlling the supply of compressed air to a plurality of inflatable devices in order to inflate them and the venting of air from the devices in order to deflate them, wherein the unit is provided with a plurality of valves operable by respective finger-operable devices, the valves being arranged in two groups and the finger-operable devices being disposed on respectively opposing faces of the control unit so that by turning the unit in the palm of the hand through approximately 180° the group of devices to be operated can be changed, the valves of one group being operatively disposed between an inlet connected or connectible to a source of compressed air and a corresponding number of individual ports connected or connectible to the inflatable devices and the valves of the other group being operatively connected between a venting outlet and either said corresponding individual ports or a corresponding number of further ports which are connected or connectible to the inflatable devices.

2. The control unit as claimed in claim 1 wherein the finger-operable devices are push buttons.

3. The control unit as claimed in claim 1 wherein the finger-operable devices are disposed in a row such that when the unit is placed in the palm of the hand, said row extends transversely with respect to the fingers.

4. The control unit as claimed in claim 1 wherein the same ports are used for the supply of the compressed air to one of the inflatable devices and the venting of air from one of said inflatable devices.

5. The control unit as claimed in claim 1 wherein at least one valve comprises a valve element having a stem and a head which is arranged to cooperate with a valve seat, the associated finger operable device being arranged to act directly on said stem.

6. A hand-held control unit for controlling the supply of compressed air to a plurality of inflatable devices in order to inflate them, and the venting of air from the devices in order to deflate them, wherein the unit is provided with the plurality of a finger-operable devices which are arranged in two groups, the finger-operable devices of one group being adapted, respectively, to control the supply of compressed air to the individual inflatable devices and the finger-operable devices of the other group being adapted, respectively, to control the venting of air from the individual inflatable devices, wherein the two groups of said devices are disposed on respectively opposite faces of the control unit so that by simply turning the unit in the palm of the hand through approximately 180° the group of devices to be operated by the fingers can be changed.

7. A control unit for inflatable devices comprising:

a housing having an end, a first side and a second side, the first side and second side being opposite from each other;

finger operable devices affixed to the first side and to the second side;

inlet valves which are operatively connected to the finger operable devices affixed to the first side;

venting valves which are operatively connected to the finger operable devices affixed to the second side;

an air inlet which is adaptable to be operatively connected to a source of compressed air;

a venting outlet which is adaptable to be operatively connected to the inflatable devices;

and ports which are adaptable to be operatively connected to the inflatable devices.

8. The control device as claimed in claim 7 wherein finger operable devices are disposed in a row so that the control device can be operated by fingers in the manner of a musical instrument when placed in a hand.

9. The control device as claimed in claim 7 wherein the venting outlet is operatively connected to the ports.

10. The control unit as claimed in claim 7 wherein the inlet valves and venting valves have a stem at one end and a head at an opposite end, the stem is received in a recess formed in the corresponding finger-operable device and the head movably engages a valve seat formed inside the housing.

11. The control unit as claimed in claim 10 wherein the control device further comprises a spring operatively connected to the finger-operable device which forces the head of the valve into engagement with the valve seat.

12. The control unit as claimed in claim 7 wherein the housing further comprises an inlet chamber formed in the housing between the air inlet and the inlet valves, secondary inlet chambers and channels which operatively connect the secondary inlet chambers to the ports.

13. The control unit as claimed in claim 7 wherein the housing further comprises an outlet chamber formed in the housing between the venting outlet and the venting valves, secondary inlet chambers and channels which operatively connect the secondary inlet chambers to the ports.

14. The control unit as claimed in claim 7 wherein the first side and second side are 180 degrees apart.

15. The control unit as claimed in claim 7 wherein the air inlet is formed at the end of the housing.

16. The control unit as claimed in claim 7 wherein the venting outlet is formed at the end of the housing.

17. The control unit as claimed in claim 7 wherein the port includes a hollow spigot.

18. The control unit as claimed in claim 7 wherein the same ports are used for the supply of the compressed air to one of the inflatable devices and the venting of air from one of said inflatable devices.

* * * * *